US011097179B2

(12) United States Patent
Mazloompour

(10) Patent No.: US 11,097,179 B2
(45) Date of Patent: Aug. 24, 2021

(54) HEADS UP SPORTS TRAINING SYSTEM

(71) Applicant: Sehat Sporting Goods LLC, Edmond, OK (US)

(72) Inventor: Behnam Mazloompour, Edmond, OK (US)

(73) Assignee: Sehat Sporting Goods LLC, Edmond, OK (US)

( * ) Notice: Subject to any disclaimer, the term of this patent is extended or adjusted under 35 U.S.C. 154(b) by 0 days.

(21) Appl. No.: 16/707,675

(22) Filed: Dec. 9, 2019

(65) Prior Publication Data

US 2020/0179788 A1 Jun. 11, 2020

Related U.S. Application Data

(60) Provisional application No. 62/917,465, filed on Dec. 7, 2018.

(51) Int. Cl.

*A63B 69/00* (2006.01)
*A63B 71/06* (2006.01)
*A63B 63/00* (2006.01)

(52) U.S. Cl.

CPC ..... *A63B 71/0622* (2013.01); *A63B 71/0605* (2013.01); *A63B 63/00* (2013.01); *A63B 2071/065* (2013.01); *A63B 2071/0683* (2013.01); *A63B 2220/10* (2013.01); *A63B 2220/805* (2013.01)

(58) Field of Classification Search

CPC ..... A63B 71/0622; A63B 71/0605; A63B 2071/0683; A63B 2220/10; A63B 2220/805; A63B 69/002; A63B 63/00

USPC ..... 473/422, 446, 438, 470, 471, 476–478, 473/451; 463/36, 247; 482/1–9, 87, 482/900–902

See application file for complete search history.

(56) References Cited

U.S. PATENT DOCUMENTS

| | | | | |
|---|---|---|---|---|
| 7,951,045 | B1 * | 5/2011 | Brader | A63B 24/0062 482/3 |
| 10,039,967 | B2 * | 8/2018 | Dunser | A63B 69/345 473/446 |
| 10,118,078 | B2 * | 11/2018 | Lewis | A63B 63/004 473/451 |
| 2007/0213126 | A1 * | 9/2007 | Deutsch | A63B 71/0686 463/36 |
| 2016/0166905 | A1 * | 6/2016 | Dunser | A63B 71/0619 473/446 |

(Continued)

FOREIGN PATENT DOCUMENTS

WO WO-2018132381 A1 * 7/2018 ..... A63B 69/34

*Primary Examiner* — Mitra Aryanpour
(74) *Attorney, Agent, or Firm* — K&L Gates LLC

(57) ABSTRACT

The present disclosure provides a sports training system including a first housing including a transmitter; a second housing including a receiver and a wireless communication module; and a plurality of illuminating targets in communication with the wireless communication module; wherein, in operation: the transmitter projects a transmission; the receiver is positioned laterally away from the transmitter and receives the projected transmission; in response to an object passing between the transmitter and receiver, the receiver is blocked from receiving the projected transmission; and in response to the receiver being blocked from receiving the projected transmission, a selected one of the targets illuminates.

9 Claims, 10 Drawing Sheets

(56) References Cited

U.S. PATENT DOCUMENTS

2017/0095716 A1* 4/2017 Lewis ..... A63B 24/0075
473/451
2019/0374843 A1* 12/2019 Elder ..... A63B 69/34
473/422

* cited by examiner

HEADS UP SPORTS TRAINING SYSTEM

BACKGROUND OF THE INVENTION

The present subject matter relates generally to a sports training system. More specifically, the present invention relates to a sports training system in which a transmitter and receiver pair are wirelessly connected to a plurality of lighted indicators or targets such that, when the transmitter and receiver pair are triggered by a person any object passing between them (e.g., a person, a ball, etc.), one or more of the lighted indicators are illuminated.

There are many sports in which it is valuable for the player to keep his or her head up and eyes on the playing space such that the participant is able to maintain focus on the action rather than looking down at the ball, puck, the participant's feet, the ground, etc. Rather than being distracted by looking down, the participant benefits from being able to view the action and make quick decisions based on the information in front of him or her. This tends to be especially true while the player is moving through space.

In general, these sports activities include an object (e.g., ball, puck, etc.) and multiple targets, some stationary (e.g., bases, goals, etc.) and some in motion (e.g., other players, etc.), with which the moving player interacts (e.g., passes to, receives from, runs to, runs from, etc.). These sports activities often involve seemingly perpetual movement involving player choices dependent upon numerous circumstances and the near constant shifting of the player's focus and attention.

For example, when playing soccer, it is important for a player to be able to dribble the ball while looking forward and around to be able to see the action and make quick decisions as to where to move, to whom to pass, whether to shoot, etc. It is the same in hockey, where a player skating with the puck benefits from being able to see the ice in front of him or her to make those same decisions. In basketball, it is important for a player dribbling the ball to see the court, rather than looking down at the ball, again to see where to move, to whom to pass, whether to shoot, etc. In football, a quarterback dropping back to pass needs to be able to look down field to see the receivers and coverage, while also being able to see the pressure coming from the defense. Similarly, a running back or receiver must first watch the ball into his or her hands before looking up to scan the field to know where to run. In baseball, a player fielding the ball must be able to quickly survey the position of the baserunners and other fielders in order to throw the ball to the correct position on the field to secure an out, prevent a runner from advancing to another base, or preventing a run.

These skills take practice to develop. Certainly, these skills can be developed in games and game-like practices. However, in more complex environments, such as games and game-like practices, it can be difficult to isolate and focus on this just specific skill. There is value then, in having a training system that isolates this skill and enables players to work on moving while keeping their eyes up on the action and making quick decisions based on the play in front of them.

Accordingly, there is a need for a sports training system that helps players develop the skill of moving while keeping their head up and their eyes on the action in front of them, as described herein.

BRIEF SUMMARY OF THE INVENTION

To meet the needs described above and others, the present disclosure provides a sports training system that helps players to develop their ability to move through space while observing and responding to the activity around them.

In a primary embodiment, the sports training system includes a transmitter and receiver pair that are intended to be placed apart from each other. In a primary embodiment, the transmitter and receiver pair may be embodied in small housings intended to be stably placed on the ground. The transmitter projects an infrared beam of light to the receiver. When any object moves between the transmitter and the receiver (e.g., a person, a ball, etc.), the infrared beam of light is disrupted (i.e., the beam projected by the transmitter is not received by the receiver's sensor), which triggers the receiver to send a signal to one or more of a plurality of targets. The targets light up, or otherwise visually respond, in a manner to which the person is to react. Accordingly, as the person passes between the transmitter and receiver, the person must have his or her head up and eyes on the targets to know what to do next.

The targets may be cones, stakes, or similar stationary objects, each incorporating one or more lights or other visual indicators. In other examples, the target may be nets, hoops, goals, baskets, or other objects meant to receive a ball or other object directed by the player. The targets may be more complex objects that further incorporate movement or sound. For example, the targets may be people wearing one or more lights or other visual indicators. Similarly, the targets may be robots having one or more lights or may be holograms or other projections that can be shown as different colors.

In another embodiment, the sports training system includes a transmitter and receiver pair that are intended to be placed apart from each other. Again, the transmitter projects an infrared beam of light to the receiver. When a person moves between the transmitter and the receiver, the infrared beam of light is disrupted (i.e., the beam projected by the transmitter is not received by the receiver's sensor), which triggers the receiver to send a signal to a multi-color indicator. The multi-color indicator has a unique colored light corresponding to each of a plurality of unique colored targets. When the person trips the infrared beam, one or more of the lights on the multi-color indicator are illuminated, or otherwise visually respond, in a manner to which the person is to react. Accordingly, as the person passes between the transmitter and receiver, the person must have his or her head up and looking at the multi-color indicator to know what to do next.

The targets may be stationary targets that have a color indicator corresponding to a color on the multi-color indicator. Again, the targets may be cones, stakes, or similar stationary objects, each including a color or light or other visual indicator corresponding to a color on the multi-color indicator. In other examples, the target may be nets, hoops, goals, baskets, or other objects meant to receive a ball or other object directed by the player, also incorporating a color corresponding to a color on the multi-color indicator. Just as with the primary example above, the targets may be more complex objects that further incorporate movement or sound. For example, the targets may be people wearing one or more colors corresponding to a color on the multi-color indicator. Similarly, the targets may be robots having one or more color corresponding to a color on the multi-color indicator or may be holograms or other projections that can be shown as different colors.

In each of the above examples, the visual indicator may be integrated into the target, may be worn by or hung on the target, may be projected onto the target (e.g., a projector may project colors or symbols or patterns onto targets to perform the visual signal function), or may otherwise be more permanently or more temporarily associated with the target.

For example, in a soccer training drill, there may be a transmitter and a receiver spaced apart so a player may dribble a soccer ball between them. There may also be a pair of targets in front of the transmitter and receiver and also spaced apart from each other. Each of the targets may have one or more color of light it can indicate. When the player dribbles a soccer ball between the transmitter and receiver, the infrared signal is disrupted, and the receiver communicates to the targets causing them to light up. In one example, when the infrared beam is disrupted, a first target may turn green and a second target may turn red. In this drill, the player may be instructed to pass the ball in the direction of the green target. Which target turns green and which turns red may be a randomized event controlled by a controller (i.e., a processor and wireless communication transmitter) in the receiver. Accordingly, until the player passes between the transmitter and receiver, the player will not know which target will turn green and which will turn red. This requires the player to be looking up while dribbling through the transmitter and receiver to identify which target to pass to. In another example, rather than each target lighting a different color, only one of the targets lights up indication which direction the player should focus his or her attention. In yet another example, all of the targets may light which may signal that all of the targets are marked, and the player should not pass the ball.

Similarly, the above drill could be modified such that the player receives a pass in which the ball passes between the transmitter and receiver pair triggering the light response in the targets indicating to which target to pass the ball. As such, the drill teaches the player to receive the ball, quickly identify and make a pass to the randomly corresponding target.

In another example, there may be a primary player, four targets capable of displaying any one or more of four colors of lights, and four players wearing correspondingly colored jerseys. When the primary player passes between the transmitter and receiver, one of the target lights comes on directing the player to a position on the field (e.g., to the illuminated target) and which point the primary player passes the ball to the player wearing the jersey with the same color as the light.

The simple examples above illustrate the basic function of the sports training system described herein. More complex versions of the sports training system may be implemented. For example, there may be a greater number of targets, increasing the difficulty in identifying what action to take next (i.e., to which target to pass the ball). The number of light options on each target might be increased so as to signal a more complex series of decisions than simply "pass to one target and not to the other." For example, a multi-color lighting system may be used in each target such that each target might light any of four (or more) distinct colors and might indicate a series of actions to take. There may also be a series of transmitter and receiver pairs such that as the player moves through each successive pair, the player is directed by the targets to take a new action.

In a more complex example, as training for a quarterback, there may be a single transmitter and receiver pair communicating with four targets. The quarterback may start in front of the transmitter and receiver pair, take a snap, and take a drop (i.e., backpedal) through the transmitter and receiver pair. In response to the infrared light beam being disrupted, the receiver may trigger the four targets to light one at a time in succession. The quarterback would be instructed to look to each target as it lights up to simulate going through the progression of reads for the passing play. Similarly, each of the four targets may include a multi-color light capable of illuminating in any one of four colors. In such example, as the quarterback drops back through the transmitter and receiver pair, each of the four targets lights up with a different color with the intention of the quarterback having to "read" the targets in a certain order (e.g., first red, then yellow, then green, then blue). In yet another example, three of the targets may light a first color and the fourth target might light a distinct color, signaling the quarterback to throw the ball at the fourth target.

In an even more complex example, a first transmitter and receiver pair may be placed behind a quarterback as described above. As the quarterback drops through the first transmitter and receiver pair, one or more of a first set of targets light up directing the player to react. A second transmitter and receiver pair may be positioned outside of the passing pocket such that when the first set of targets light in a manner that directs the quarterback to run, the quarterback may run through the second transmitter and receiver pair, thereby causing one of a second transmitter and receiver pair to light to indicate which direction the quarterback is to cut to redirect path. For example, the second set of targets may be set downfield to the left and right of the second transmitter and receiver pair. As the quarterback passes through the second transmitter and receiver pair, one of the second set of targets lights to direct the quarterback to run to the left or to the right.

As noted above, the targets may be people wearing colored jerseys or elements that light up a specific color in response to the triggering of the transmitter and receiver pair. The flexibility of human targets, particularly with respect to their mobility and responsiveness, increases the system's complexity such that even more advanced training drills can be achieved.

The number of transmitter and receiver pairs, the number of associated targets, the number of colors each target may signal, the timing of the lighting and similar variables may all be manipulated to create simpler and more complex training exercises.

In some embodiments, the sports training system includes a remote control for triggering the visual indicators. For example, a coach may have a handheld remote that can control which of the targets illuminates when an object passes through the transmitter and receiver. In another example, the remote may be embodied in a mobile application on a mobile device. In a more complex application, the targets may be smart targets that track the activity by the users. For example, the targets may include sensors that track the player's accuracy in the drills. In one example, each target may include a hoop, or similar goal, that identifies whether the ball has been passed through the goal in response to a corresponding visual indicator. The system may keep track of the player statistics and report to the mobile application such that the users have a record of the player's performance over time.

In one example, a sports training system includes: a first housing including a transmitter; a second housing including a receiver and a wireless communication module; and a plurality of illuminating targets in communication with the wireless communication module; wherein, in operation: the transmitter projects a transmission; the receiver is positioned laterally away from the transmitter and receives the projected transmission; in response to an object passing between the transmitter and receiver, the receiver is blocked from receiving the projected transmission; and in response to the receiver being blocked from receiving the projected transmission, a selected one of the targets illuminates.

In another example, a sports training system includes: a first housing including a transmitter; a second housing including a receiver and a wireless communication module; a multi-color indicator in communication with the wireless communication module; and a plurality of colored targets corresponding to the colors on the multi-color indicator; wherein, in operation: the transmitter projects a transmission; the receiver is positioned laterally away from the transmitter and receives the projected transmission; in response to an object passing between the transmitter and receiver, the receiver is blocked from receiving the projected transmission; and in response to the receiver being blocked from receiving the projected transmission, a selected one of the colors on the multi-color indicator illuminates.

In another example, a method of using a sport training system comprises the steps of: projecting a transmission from the transmitter to the receiver; receiving the transmission in the receiver; and in response to an object passing between the transmitter and receiver, illuminating a selected one of the plurality of targets, wherein the sport training system includes a first housing including a transmitter; a second housing including a receiver and a wireless communication module; a multi-color indicator in communication with the wireless communication module; and a plurality of colored targets corresponding to the colors on the multi-color indicator.

In each of the examples above, the selection of one of the targets or colors to illuminate may be random or pseudo-random. The selection of one of the targets to illuminate may be directed by an input from a remote control. The remote control may be a mobile device. The transmitter and the receiver may each include a base, a cap, and a leveling mechanism that enables the cap to be repositioned with respect to the base to align for communication between the transmitter and the receiver. The projected transmission may be an infrared beam.

An object of the present system is to improve a player's ability to focus on the action in front and around them.

Another object of the present system is to improve a player's anticipation by training the user to focus on receipt and redirection of the sports object to a subjective and random target subsequent to receipt during the time that the sports object is in the process of arriving.

An advantage of the present system is that it may be operated with or without the assistance of another person, depending upon the setup of the system.

Another advantage of the present system is that it is scalable to be configured for simpler or more complex training scenarios.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

The following detailed description provides examples of implementations of the sports training system. Although the examples provided below mainly focus on training drills related to soccer, it is understood that the systems provided herein may be applied to training in many sports, including, but not limited to, soccer, hockey, football, baseball, and basketball. In general, the teachings provide herein may be applicable to skills training for any athletic activity that involves objects, targets, and player reaction based on the observation of the environment.

Figure 1:
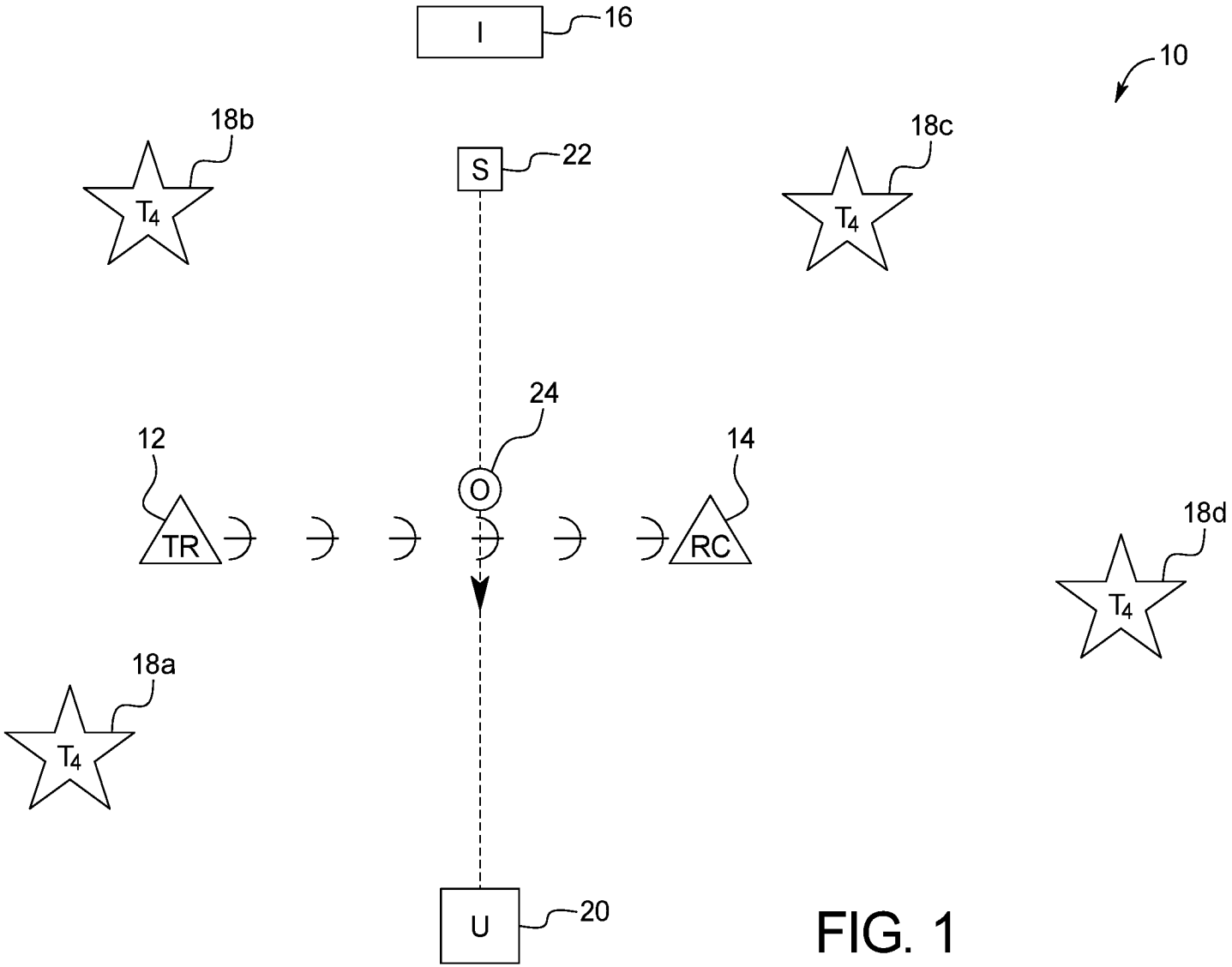
FIG. 1 is a schematic representation of an example of a sports training system.

FIG. 1 is a schematic representation of a first example of a sports training system 10. As shown in FIG. 1, the sports training system 10 includes a transmitter 12, a receiver 14, a multi-color indicator 16, four targets 18*a*-18*d*, a first player 20, a second player 22, and a ball 24.

In the example shown in FIG. 1, the transmitter 12 projects an IPLED beam towards the receiver 14, which receives the IPLED beam. The communication between the transmitter 12 and the receiver 14 is continuous, creating a space between the transmitter 12 and the receiver 14 through which any passing object, such as the ball 24, will break the communication between the transmitter 12 and the receiver 14. A break in the communication between the transmitter 12 and the receiver 14 causes a wireless communication module 30 in the receiver 14 to send a signal to the multi-color indicator 16. A processor 32 is located in either the receiver 14 (see, FIG. 5*b*) or the multi-color indicator 16. When the processor 32 is located in the receiver 14, the processor 32 determines what signal to send to the multi-color indicator 16. When the processor 32 is located in the multi-color indicator 16, the processor 32 determines how to respond to the signal received. In either instance, the communication of the signal from the receiver 14 to the multi-color indicator 16 causes a scripted, random, or pseudo-random color to light on the multi-color indicator 16. The color corresponds to one of the four targets 18*a*-18*d*. In this example, each of the four targets 18*a*-18*d* has a fixed color association. For example, the first target 18*a* may be red, the second target 18*b* may be yellow, the third target 18*c* may be green, and the fourth target 18*d* may be blue.

In use, the second player 22 passes the ball to the first player 20. As the ball 24 passes between the transmitter 12 and the receiver 14, the communication between them is broken and the receiver 16 sends a signal to the multi-color indicator 16. In response, the multi-color indicator 16 lights up a random color. In this example, the multi-color indicator 16 lights up as yellow, which corresponds to the second target 18*b*. Accordingly, as the first player 20 receives the pass from the second player 22, the multi-color indicator 16 lights up yellow to indicate to the first player 20 to pass the ball 24 in the direction of the second target 18*b*. Neither the first player 20, nor the second player 22 knows in advance which target or colored light will be selected by the processor 32.

Figure 2:
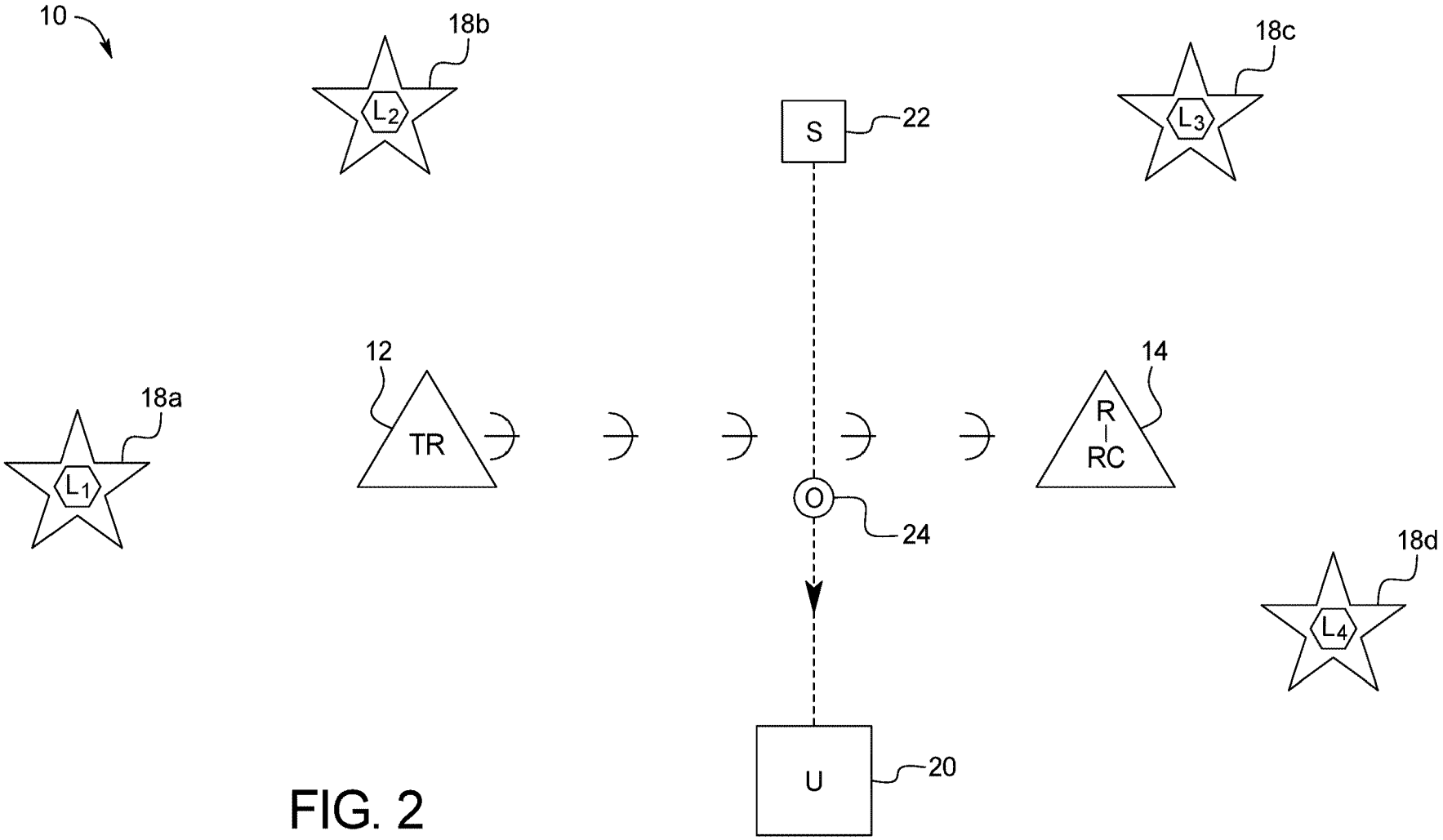
FIG. 2 is a schematic representation of another example of a sports training system.

FIG. 2 is a schematic representation of a second example of a sports training system 10. As shown in FIG. 2, the sports training system 10 includes a transmitter 12, a receiver 14, four targets 18*a*-18*d*, a first player 20, a second player 22, and a ball 24.

In the example shown in FIG. 2, the transmitter 12 projects an IPLED beam towards the receiver 14, which receives the IPLED beam. The communication between the transmitter 12 and the receiver 14 is continuous, creating a space between the transmitter 12 and the receiver 14 through which any passing object will break the communication between the transmitter 12 and the receiver 14. A break in the communication between the transmitter 12 and the receiver 14 causes a wireless communication module 30 in the receiver 14 to send a signal to one of the four targets 18*a*-18*d*. The selection of the target 18 is made by the processor 32 in the receiver 14. The selection may be scripted, or it may be random or pseudo-random. The target 18 receiving the signal lights up. Each target 18 may have one or more lights that can visually signal in one or more colors.

In use, the second player 22 passes the ball to the first player 20. As the ball 24 passes between the transmitter 12 and the receiver 14, the communication between them is broken and the receiver 16 sends a signal to a random one or the targets 18*a*-*d*. In this example, the signal is sent to the third target 18*c*. Accordingly, as the first player 20 receives the pass from the second player 22, the third target 18*c* lights indicating that the first player 20 is to pass the ball 24 in the direction of the third target 18*c*.

Figure 3:
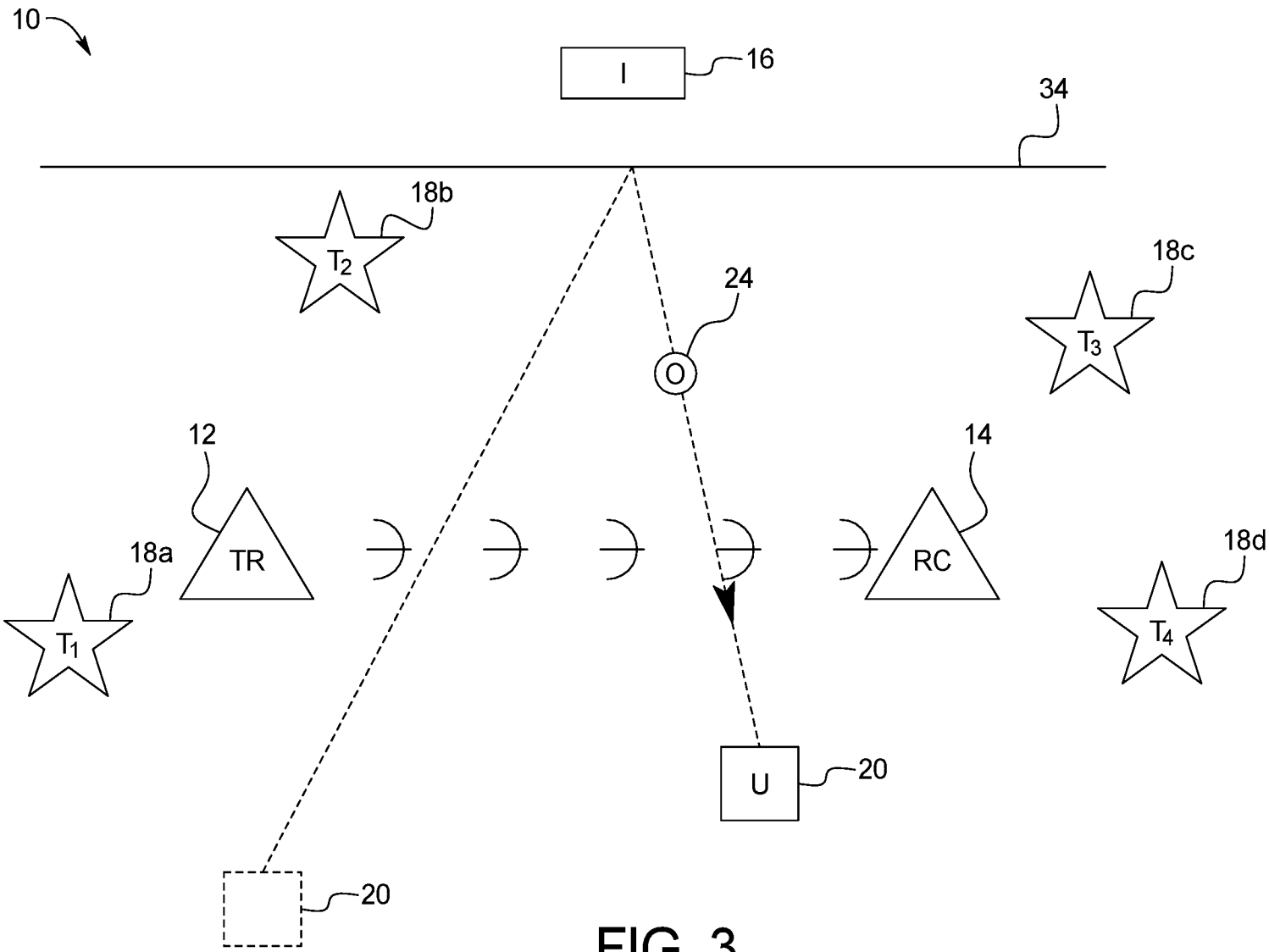
FIG. 3 is a schematic representation of another example of a sports training system.

FIG. 3 is a schematic representation of a third example of a sports training system 10. As shown in FIG. 3, the sports training system 10 includes a transmitter 12, a receiver 14, a multi-color indicator 16, four targets 18*a*-18*d*, a first player 20, a second player 22, a ball 24, and a rebounding surface 34.

This example is similar to the example shown in FIG. 1, only there is no second player 22, the first player instead passes the ball 24 to himself or herself by kicking it off of a rebounding surface 34, such as, for example, a wall or a rebounding device such as the one sold under the trademark SOCCERWAVE. Accordingly, when the first player 20 kicks the ball 24 off the rebounding surface 34, the ball 24 may break the communication between the transmitter 12 and receiver 14 two times. In such cases, the wireless communication module 30 may communicate its signal in response to the first or second break in communication between the transmitter 12 and receiver 14.

Figure 4:
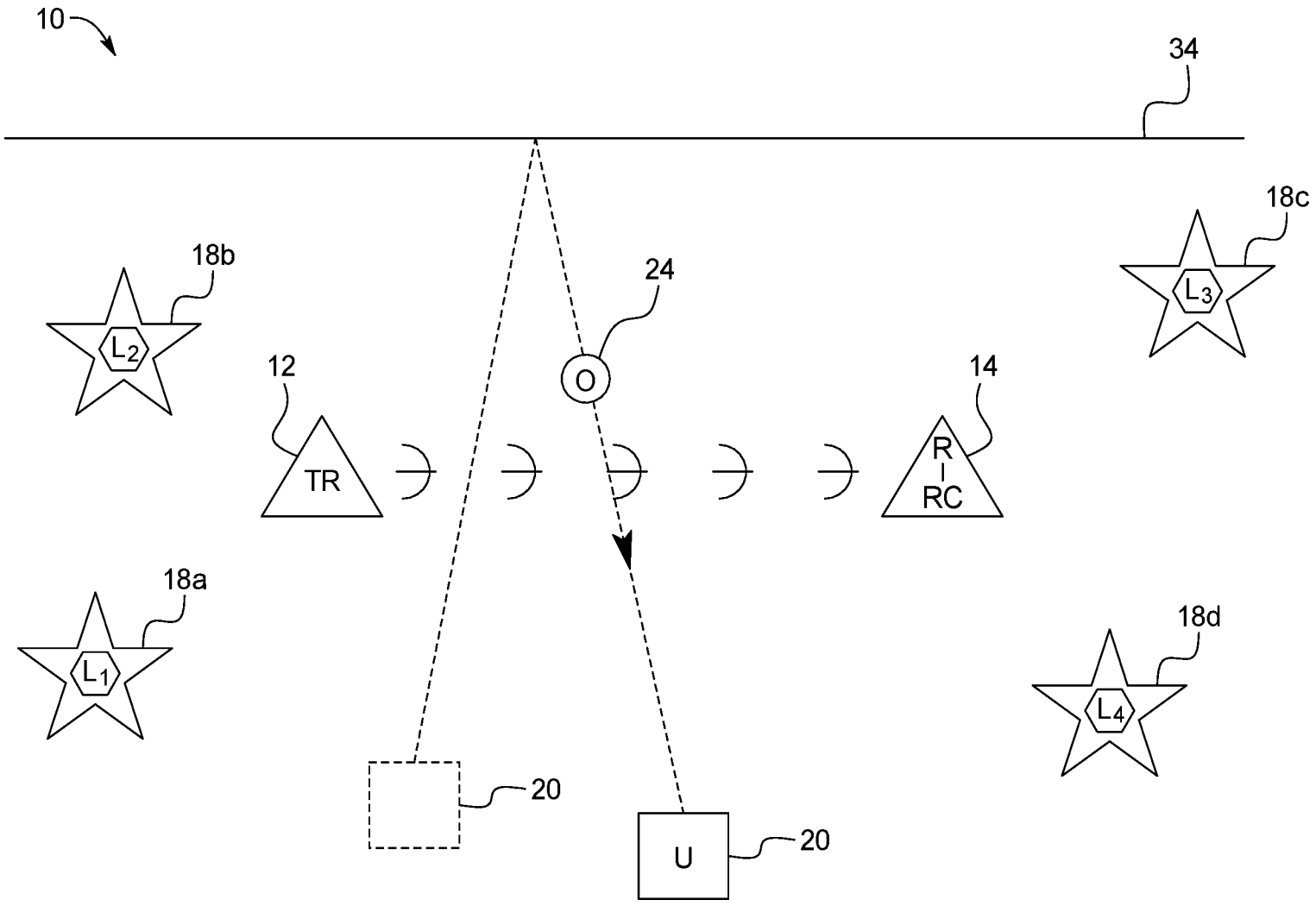
FIG. 4 is a schematic representation of another example of a sports training system.

FIG. 4 is a schematic representation of a fourth example of a sports training system 10. As shown in FIG. 4, the sports training system 10 includes a transmitter 12, a receiver 14, four targets 18*a*-18*d*, a first player 20, a ball 24, and a rebounding surface 34.

This example is similar to the example shown in FIG. 2, only there is no second player 22, the first player instead passes the ball 24 to himself or herself by kicking it off of a rebounding surface 34. Again, the ball 24 may break the communication between the transmitter 12 and receiver 14 two times. In such cases, the wireless communication module 30 may communicate its signal in response to the first or second break in communication between the transmitter 12 and receiver 14.

Figure 5A:
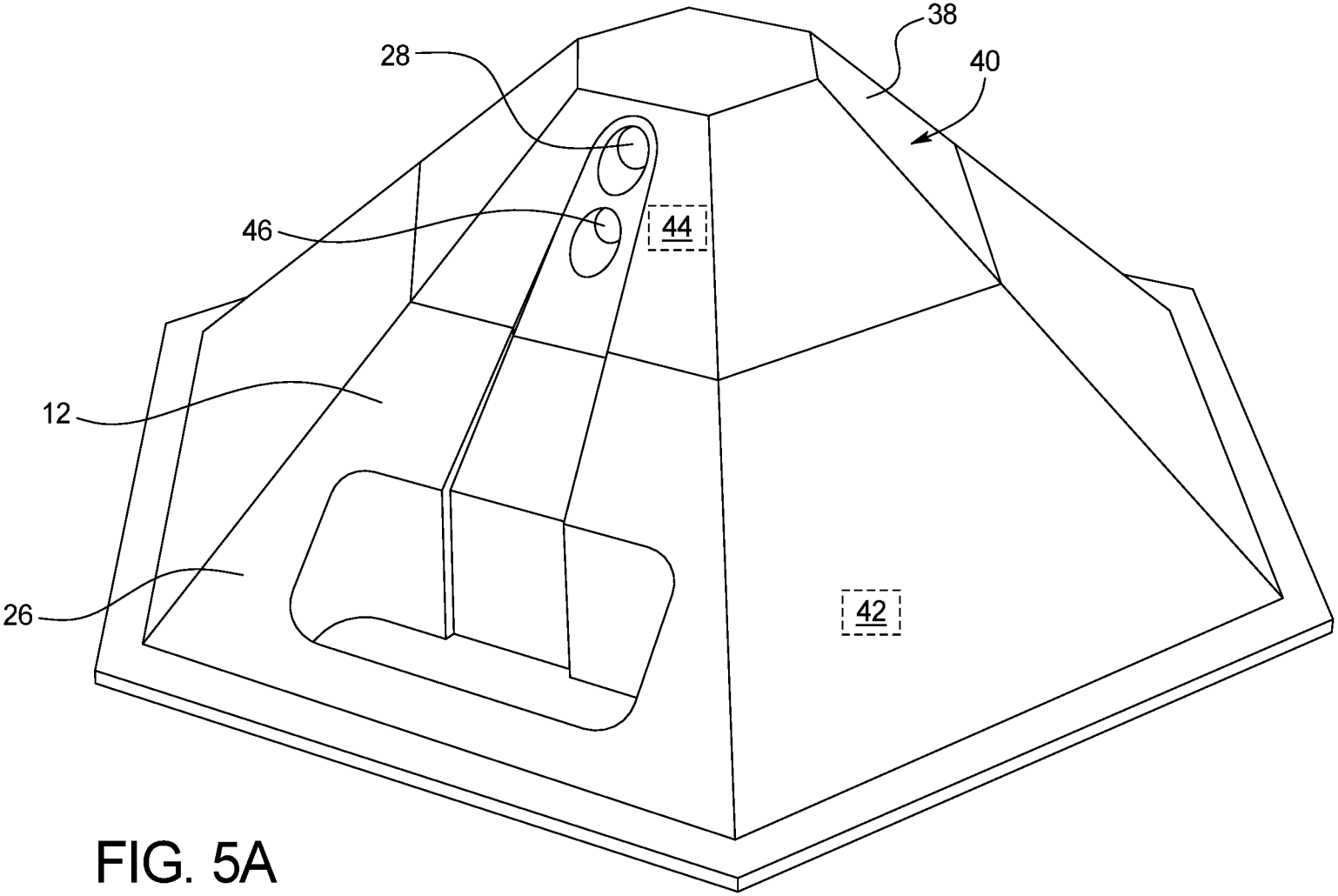
FIG. 5*a* is a perspective view of a transmitter.

FIG. 5*a* is a perspective view of a transmitter 12. The transmitter 12 includes a base 36, a cap 38 mounting upon the base 36, an adjustment mechanism 40 to level and finely position the cap 38 (e.g., a multipoint leveling adjuster), an inner rechargeable power supply 42, and a transmitter signal device 44 and a transmitter lens 46 integrated within the cap 38. A power switch 28 is shown above the transmitter lens 46.

Figure 5B:
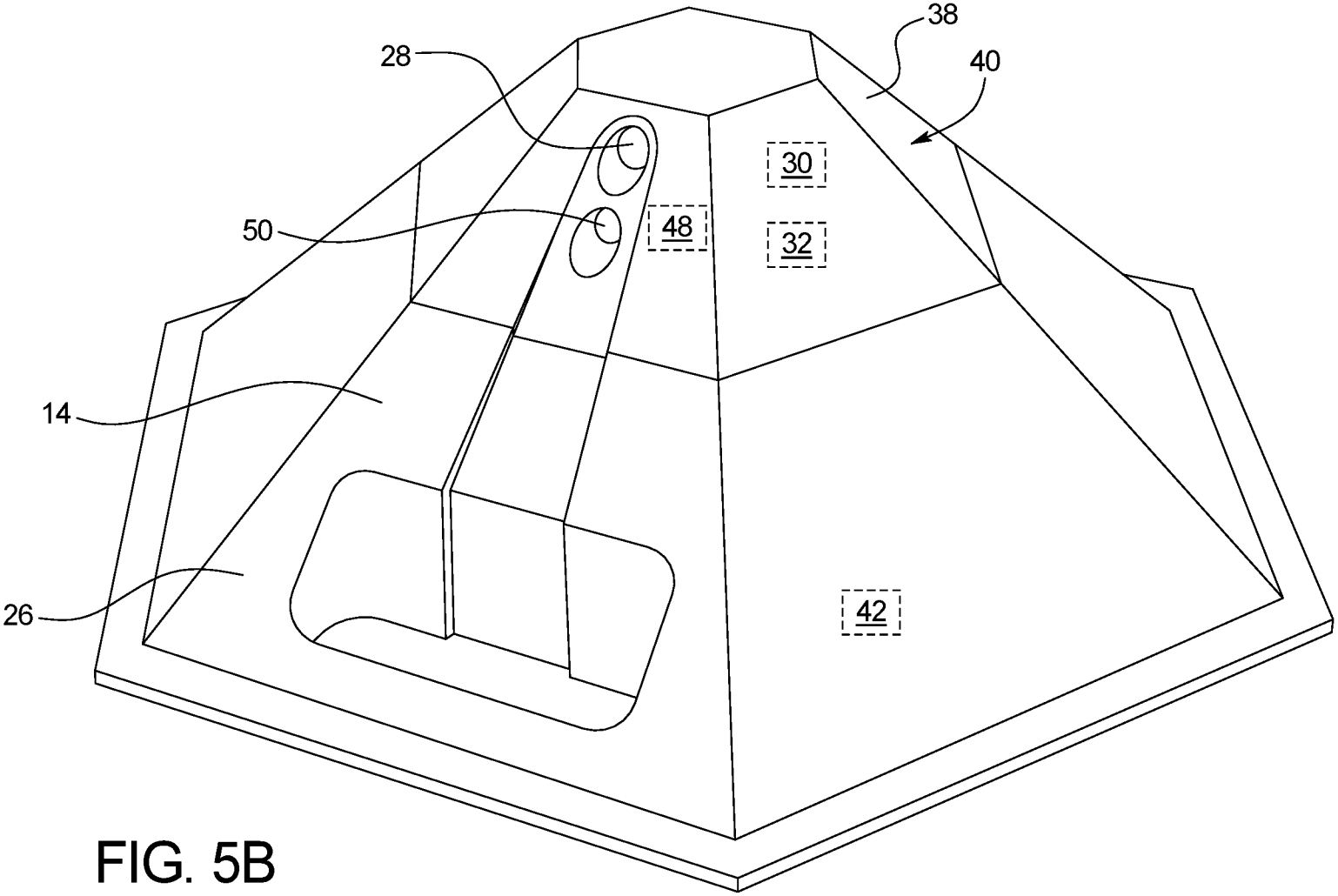
FIG. 5*b* is a perspective view of a receiver.

FIG. 5*b* is a perspective view of a receiver 14. The receiver 14 includes a base 36, a cap 38 mounting upon the base 36, an adjustment mechanism 40 to level and finely position the cap 38 (e.g., a multipoint leveling adjuster), an inner rechargeable power supply 42, and a receiver signal device 48 with a receiver lens 50 integrated within the cap 38. In addition, the receiver 14 includes the wireless communication module 30 and processor 32, as described above with respect to FIGS. 1-4. A power switch 28 is shown above the receiver lens 50.

Figure 6:
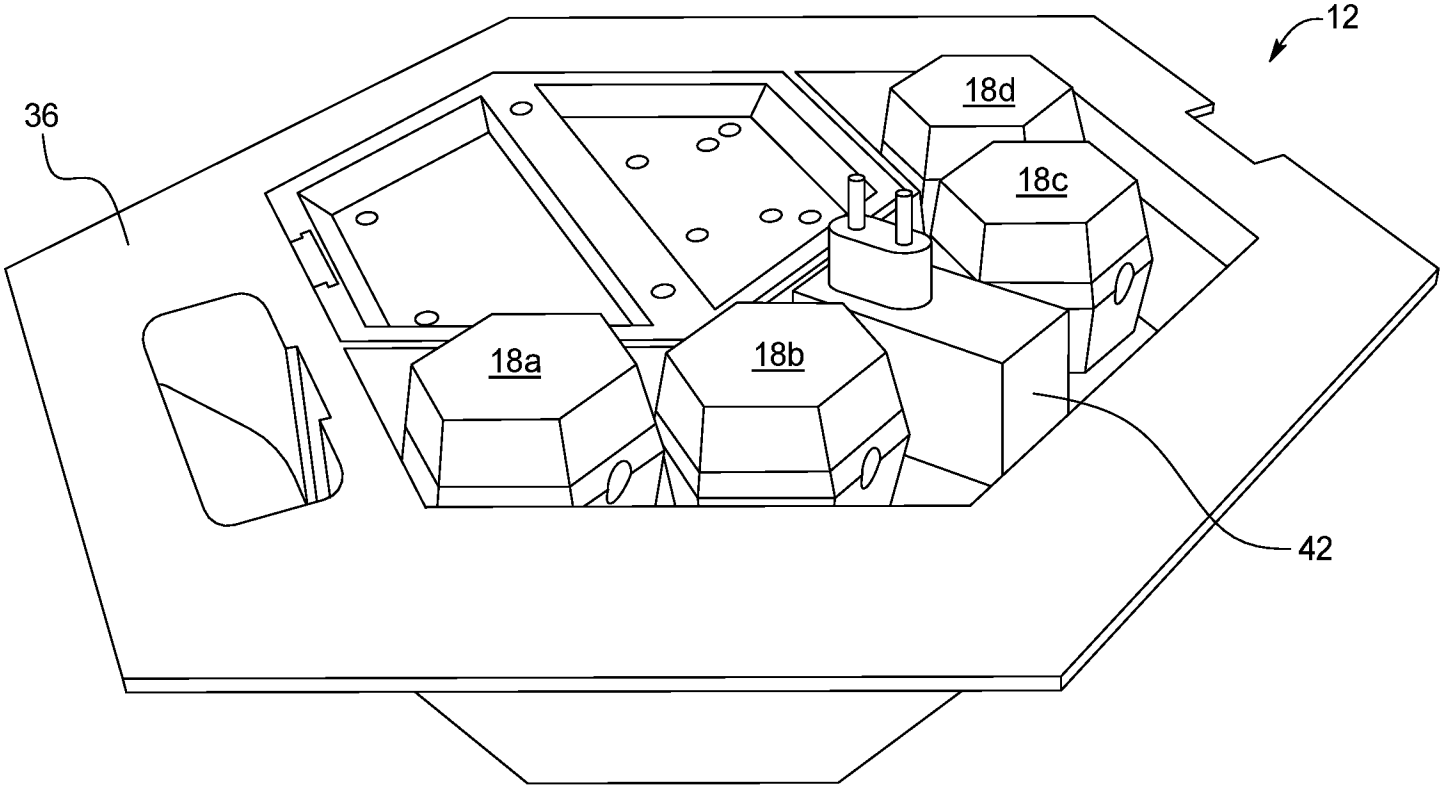
FIG. 6 is a perspective view of the bottom of the transmitter and receiver shown in FIG. 5.

FIG. 6 illustrates the bottom of the transmitter 12 shown in FIG. 5*a*. As shown in FIG. 6, the base 36 may be used to hold the power supply 42 and the targets 18*a*-18*d*. In this example, the targets 18*a*-18*d* are lights.

As shown in FIGS. 1-4, in use, the transmitter 12 and receiver 14 are placed on the ground with the transmitter lens 46 and receiver lens 52 directed towards one another. The adjustment mechanism 40 on each of the transmitter 12 and receiver 14 provides fine adjustment with which to finalize the transmitter lens 46 and receiver lens 52 alignment. A wireless signal beam, preferably an IRLED signal similar to that used in television remote signal transmission, has been found most reliable, but other FCC approved transmission signals are contemplated. The signal is sent and received by the respective transmitter 12 and receiver 14 with power supplied through the respective rechargeable power supplies 42. This signal is constant once activated. The ball 24, when passing through the wireless signal beam, interrupts the signal, which electronically triggers the receiver 14 to activate the wireless communication module 30 to send a signal transmission to the multi-color indicator 16 or one or more of the four targets 18.

The targets 18 may be basic stationary targets 18 that have some color indicator corresponding to the colors of the multi-colored indicator 16. The targets 18 can be simple cones with a colored fabric drape, a stake with a colored plate, a net, or some other colorized device for the first player 20 to aim towards. In another example, the targets 18 may include a light that is illuminated when a signal is received from the wireless communication module 30.

As noted above, the barrier 34 associated with the single user embodiments may be something as simple as a wall, the side of a house, or a more sophisticated sports device. Some examples of these more challenging self-return devices include the soccer ball return training device sold under the trademark SOCCERWAVE, a pitch-back screen used for baseball or softball, an elastic panel associated with hockey puck return, etc.

The signal transmitted by the transmitter 12 and received by the receiver 14 may be any wireless signal known in the art or arising in the future, including short range FM, RF, infrared signal, low frequency short wave signal, laser, WiMAX, Wi-Fi, Bluetooth, LAN or ZigBee. This is not an exhaustive list of wireless transmission signaling devices or technologies.

FIGS. 7*a*-7*b*, 8*a*-8*b*, and 9*a*-9*c* each illustrate examples of the sports training system 10 in use. These examples are non-exhaustive, but help to illustrate to those skilled in the art various ways in which the sports training system 10 may be used.

Figure 7A:
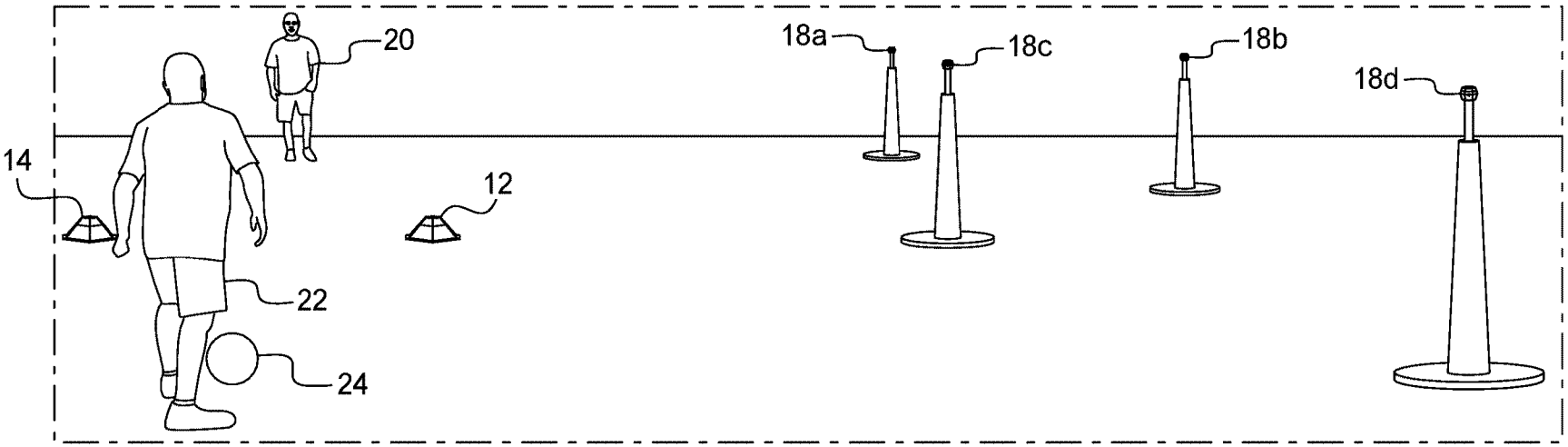
FIGS. 7*a*-7*b* illustrates an application of a sports training system as a soccer training drill.

In the example shown in FIG. 7*a*, a first player 20 is positioned to receive a pass from a second player 22. The transmitter 12 and receiver 14 are positioned such that the pass from the second player 22 to the first player 20 will trigger one of the four targets 18*a*-18*d*.

Figure 7B:
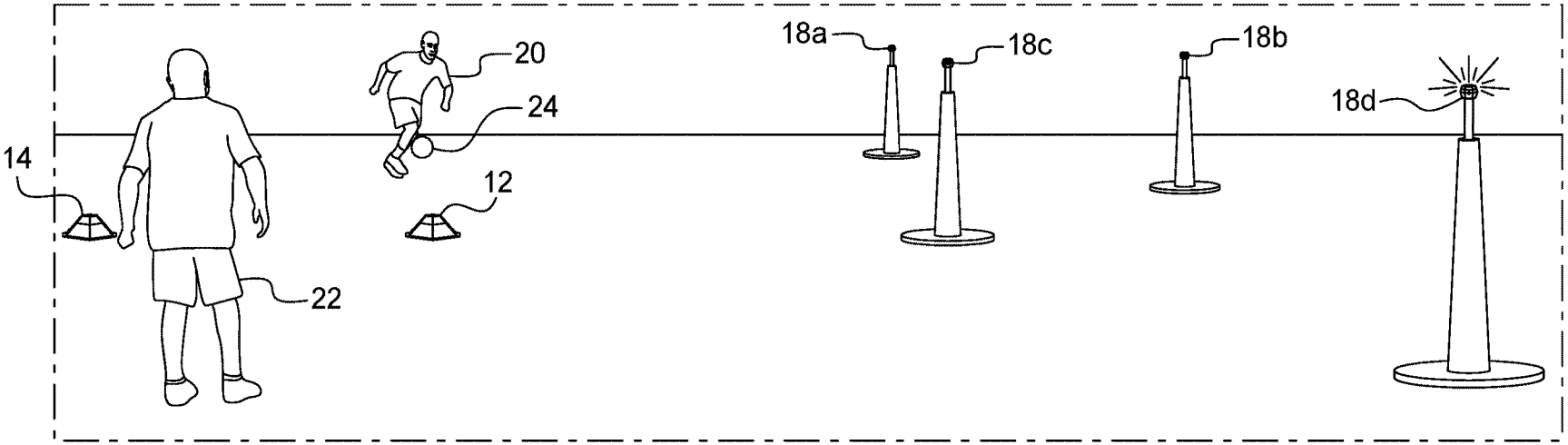

As shown in FIG. 7*b*, after the soccer ball 24 has passed through the transmitter 12 and receiver 14, the fourth target 18*d* illuminates and the player is directed to dribble or pass towards the fourth target 18*d*.

Figure 8A:
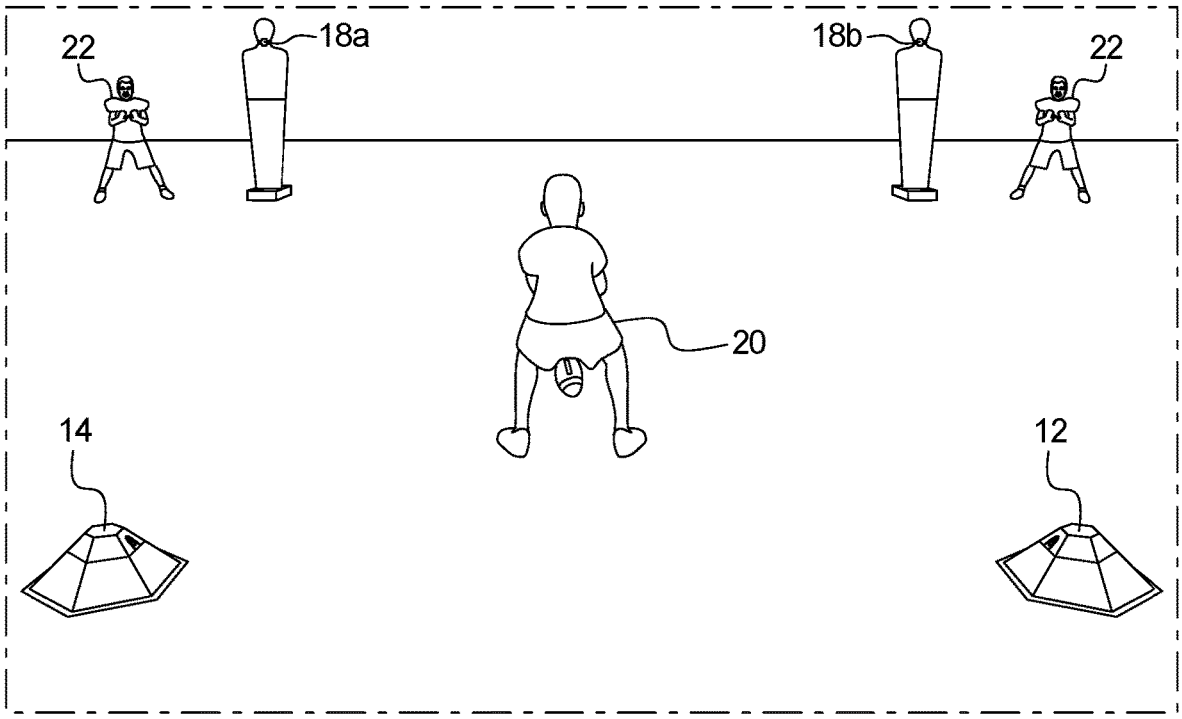
FIG. 8*a*-8*b* illustrate an application of a sports training system as a football passing training drill.
Figure 8B:
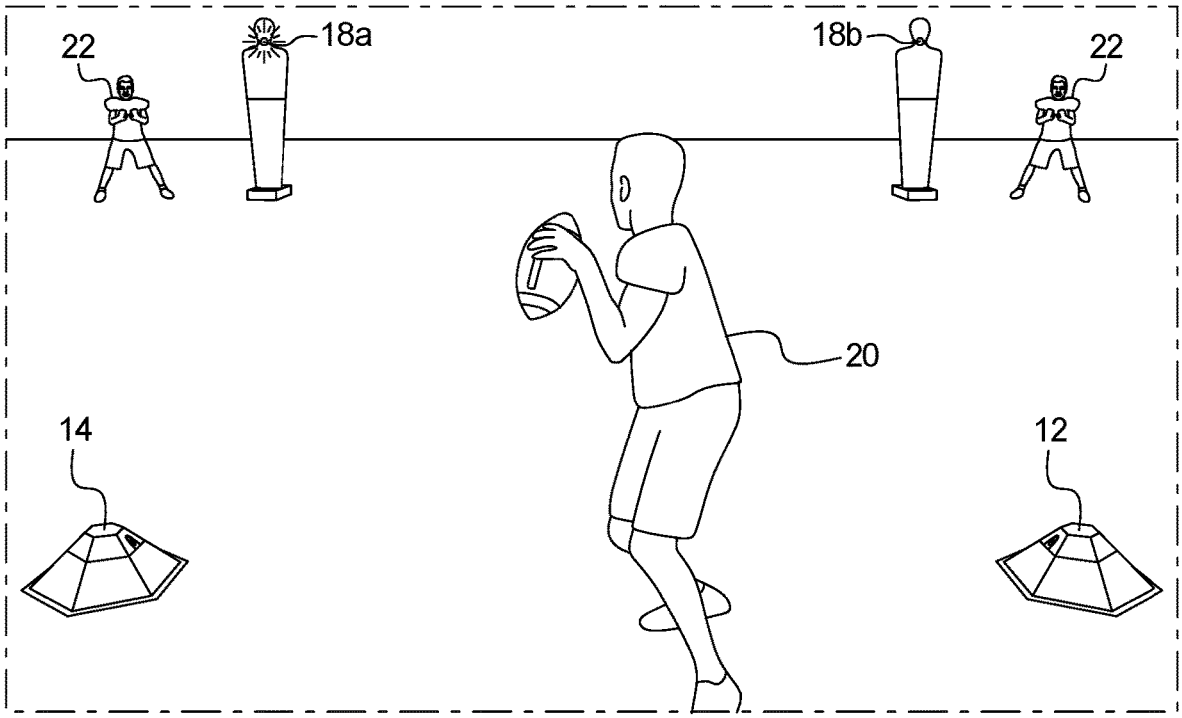

In the example shown in FIGS. 8*a*-8*b*, there is a first player 20 and two second players 22. The transmitter 12 and receiver 14 are positioned such that as the first player 20 (e.g., the quarterback) drops back to pass, one of the two targets 18*a*-18*b* illuminates and the first player 20 is directed to pass the football to the second player 22 adjacent the illuminated target 18*a*.

Figure 9A:
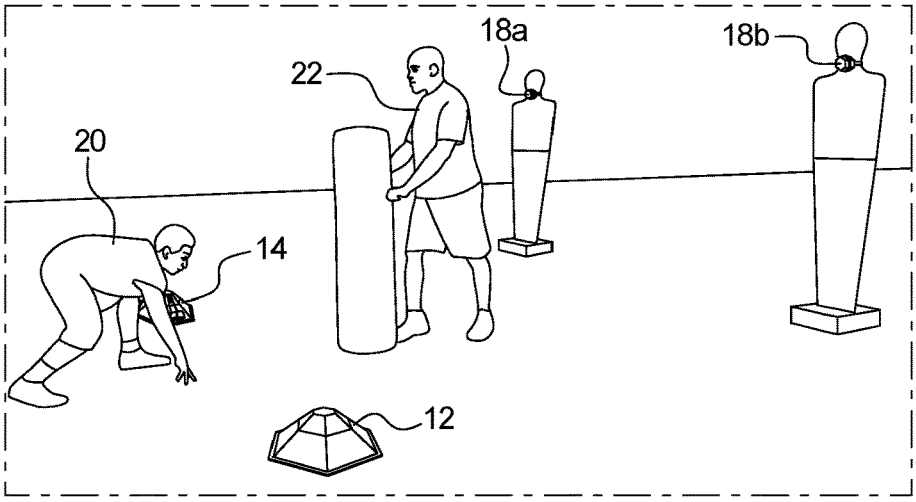
FIGS. 9*a*-9*c* illustrate an application of a sports training system as a football blocking training drill.
Figure 9B:
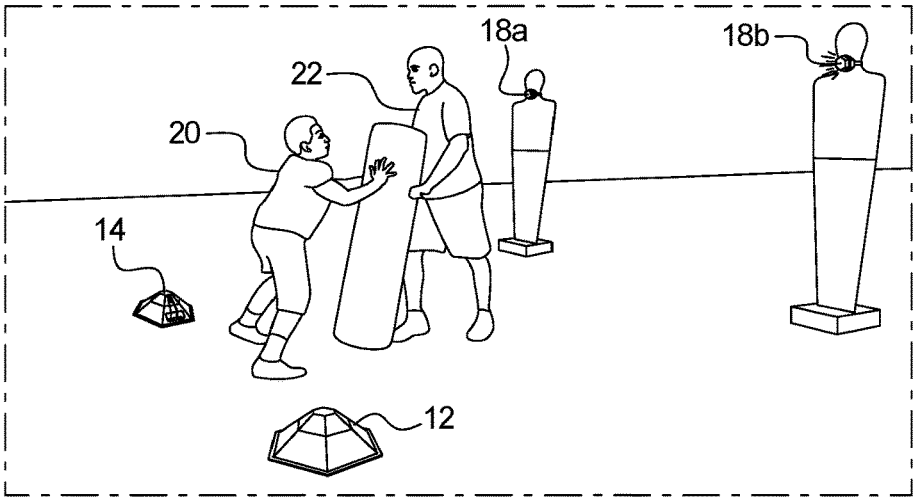
Figure 9C:
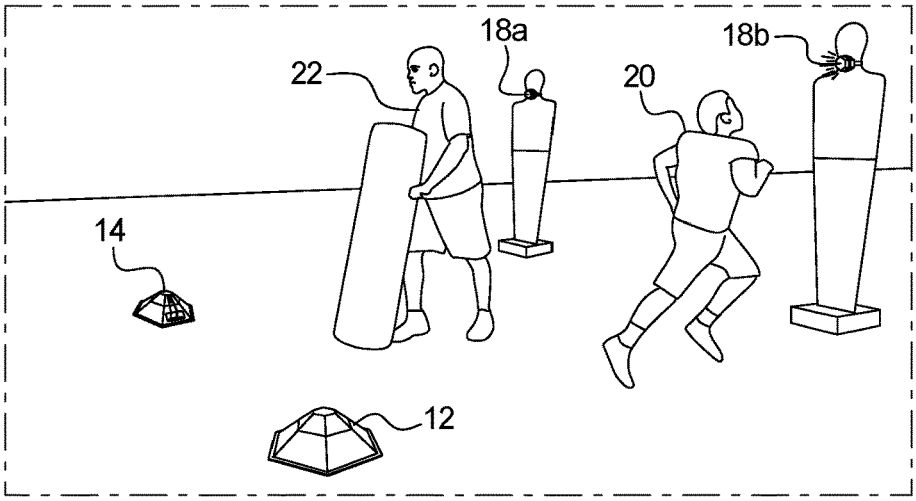

In the examples shown in FIG. 9*a*-9*c*, there is a first player 20 and a second player 22. The transmitter 12 and receiver 14 are positioned such that when the first player 20 comes out of his stance to hit the dummy held by the second player 22, one of the two targets 18*a*-18*b* illuminates and the first player 20 is directed to run towards the illuminated target 18*b* after shedding the block.

Alternatively, or in addition to the elements described above, the system 10 may include a remote control. The remote control may be used by the second player 22 (e.g., a coach or training partner) to control which colored light on the multi-colored indicator 16 or light on the selected target 18 is illuminated, as opposed to an automated random selection created by the processor 32. Similarly, an application may be provided on a mobile device allowing the third-party (i.e., second player 22, coach, training partner, etc.) the features and functions of the remote control.

In a more complex application, the targets 18 may be smart targets 18 that track the activity by the users. For example, the targets 18 may include one or more sensors to track the user's accuracy in drills. In one example, each target 18 may include or be associated with a hoop, or similar goal, that identifies whether the ball 24 (or other object) has been passed through the goal in response to a corresponding visual indicator. Similarly, the target 18 may have proximity sensors to determine whether a user passes the target 18 in response to the visual indication. Such data observed and collected by the smart targets 18 may be communicated to the processor 32 and/or to the mobile application. The system may keep track of the player statistics and report to the mobile application, either directly through or via a cloud computing system, such that the users have a record of the player's performance over time. Any number of statistics may be tracked, including time of use, accuracy in the drills, etc.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A sports training system comprising:

a first housing including a first base and a first cap, wherein the first cap includes a transmitter and a transmitter lens exposed along a side of the first cap, further wherein the first base, on a bottom side opposite to the first cap, includes a first recessed surface in which a plurality of illuminating targets may be positioned and stored; and a second housing including a second base and a second cap, wherein the second cap includes a receiver, a wireless communication module, and a receiver lens exposed along a side of the second cap, further wherein the second base, on a bottom side opposite to the second cap, includes a second recessed surface in which the plurality of illuminating targets may be positioned and stored;

wherein, in operation:

the plurality of illuminating targets are in communication with the wireless communication module;

the transmitter projects a transmission through the transmitter lens;

the receiver is positioned laterally away from the transmitter and receives the projected transmission through the receiver lens;

in response to an object passing between the transmitter and receiver, the receiver is blocked from receiving the projected transmission; and in response to the receiver being blocked from receiving the projected transmission, a selected one of the targets illuminates.

2. The system of claim 1, wherein the selection of one of the targets to illuminate is random or pseudo-random.

3. The system of claim 1, wherein the selection of one of the targets to illuminate is directed by an input from a remote control.

4. The system of claim 3, wherein the remote control is a mobile device.

5. The system of claim 1, wherein the projected transmission is an infrared beam.

6. A method of using a sport training system comprising: a first housing including a first base and a first cap, wherein the first cap includes a transmitter and a transmitter lens exposed along a side of the first cap, further wherein the first base, on a bottom side opposite to the first cap, includes a first recessed surface in which a plurality of illuminating targets may be positioned and stored; and a second housing including a second base and a second cap, wherein the second cap includes a receiver, a wireless communication module, and a receiver lens exposed along a side of the second cap, further wherein the second base, on a bottom side opposite to the second cap, includes a second recessed surface in which the plurality of illuminating targets may be positioned and stored, the method comprising the steps of:

projecting a transmission from the transmitter to the receiver;

receiving the transmission in the receiver; and in response to an object passing between the transmitter and receiver, a selected one of the targets illuminates.

7. The method of claim 6, wherein the selection of one of the targets to illuminate is random or pseudo-random.

8. The system of claim 6, wherein the selection of one of the targets to illuminate is directed by an input from a remote control.

9. The system of claim 8, wherein the remote control is a mobile device.

* * * * *